US010424152B1

(12) United States Patent
Hamman et al.

(10) Patent No.: US 10,424,152 B1
(45) Date of Patent: Sep. 24, 2019

(54) METHOD AND APPARATUS FOR ENABLING VARIABLE WAGERING ODDS ON A COMMON DRAWING VIA ASSIGNED BINS AND MODULO FUNCTIONS

(71) Applicant: SCA Promotions, Inc., Dallas, TX (US)

(72) Inventors: Robert D. Hamman, Dallas, TX (US); Kenneth E. Irwin, Jr., Dawsonville, GA (US)

(73) Assignee: SCA Promotions, Inc., Dallas, TX (US)

( * ) Notice: Subject to any disclaimer, the term of this patent is extended or adjusted under 35 U.S.C. 154(b) by 0 days.

(21) Appl. No.: 16/372,974

(22) Filed: Apr. 2, 2019

Related U.S. Application Data

(60) Provisional application No. 62/683,969, filed on Jun. 12, 2018.

(51) Int. Cl.
*G07F 17/32* (2006.01)

(52) U.S. Cl.
CPC ..... *G07F 17/3227* (2013.01); *G07F 17/329* (2013.01)

(58) Field of Classification Search
USPC ..... 463/17
See application file for complete search history.

(56) References Cited

U.S. PATENT DOCUMENTS 5,938,196 A 8/1999 Antoja
6,234,478 B1 5/2001 Smith
8,662,998 B2 3/2014 Schueller
8,747,209 B2 6/2014 Badrieh
9,687,740 B1 6/2017 Grubmueller, Jr.
2003/0050109 A1 3/2003 Caro et al.
2004/0058726 A1 3/2004 Klugman
2008/0146323 A1* 6/2008 Hardy ..... G07F 17/32 463/25
2009/0131132 A1 5/2009 Kohls et al.
2009/0227320 A1 9/2009 McBride
2010/0029376 A1* 2/2010 Hardy ..... G07F 17/32 463/25
2010/0222136 A1 9/2010 Goto et al.
2011/0275438 A9* 11/2011 Hardy ..... G07F 17/32 463/42
2011/0281629 A1 11/2011 Meyer
2013/0244745 A1 9/2013 Guziel et al.
2014/0106866 A1* 4/2014 Hardy ..... G07F 17/32 463/25
2016/0232750 A1* 8/2016 Hardy ..... G07F 17/32

* cited by examiner

*Primary Examiner* — Pierre E Elisca
(74) *Attorney, Agent, or Firm* — Panitch Schwarze Belisario & Nadel LLP

(57) ABSTRACT

A system and method are provided for allowing a plurality of consumers to each select his or her own fixed odds and associated winning payoff from a common universal drawing. The consumer selected custom odds are derived by subdividing one drawing event into a series of variable sized "bins" that reduce wagered odds to a subset of the greater odds of the universal drawing where the totality of generated bins thereby contains 100% of the possible drawing outcomes. A modulo operation is then performed to create a unique pointer position to a congruence number for each of the created previously created bins. Thus, any desired subset of reduced wagering odds can be achieved with the virtual creation of the corresponding number of bins.

16 Claims, 8 Drawing Sheets

START

↓

500 – Create *n* number of virtual bins of at least one size to be mathematically compatible with the desired odds and corresponding payout

↓

502 – Generate the corresponding modulo number such that there is one unique modulo pointer position in each of the *n* virtual bins

↓

504 – Save the *n* number of virtual bins and congruence numbers

↓

506 – Record consumer selections of odds or payouts for universal draw game tickets purchased by the consumers

↓

508 – Assign unique serial numbers to the purchased universal draw game tickets, and save for each of the purchased universal draw game tickets (i) the unique serial numbers, (ii) the corresponding consumer selected odds or payouts, and (iii) associated modulo numbers

↓

510 – After the universal draw game has been concluded, validate the purchased universal draw game tickets against the universal draw game result

↓

END

FIG. 5

METHOD AND APPARATUS FOR ENABLING VARIABLE WAGERING ODDS ON A COMMON DRAWING VIA ASSIGNED BINS AND MODULO FUNCTIONS

CROSS-REFERENCE TO RELATED APPLICATION

This application claims the benefit of U.S. Provisional Patent Application No. 62/683,969 filed Jun. 12, 2018, which is incorporated herein by reference in its entirety.

BACKGROUND OF THE INVENTION

1. Field of the Invention

The present invention relates to a system and method for allowing a plurality of consumers to each select his or her own fixed odds and associated payoff (assuming the wager wins) from a common universal drawing by subdividing one drawing event into a series of variable sized "bins" that reduce wagered odds to a subset of the greater overall odds of the universal drawing. This reduction in wagered odds (i.e., greater chance of winning from a consumer's perspective) is achieved by creating a plurality of bins each containing a portion of the possible universal drawing outcomes, the totality of bins thereby containing 100% of the possible drawing outcomes. Additionally, a modulo operation is performed to create a unique pointer for each of the previously created bins. Thus, any desired subset of reduced wagering odds can be achieved with the virtual creation of the corresponding number of bins. This system creates new flexible wagering to allow consumers to fine tune their wagers to whatever risk and reward potential payoffs they desire, thereby greatly enhancing the marketability and desirability of "standard" draw games.

2. Background

Typically, a draw game is a form of gambling that involves wagering on a future drawing of numbers or other indicia in "lots" for a prize. The history of draw games can be traced back thousands of years. By most accounts, draw games originated in China with a game that is now known as "Keno" that was utilized by the state to raise funds for the construction of the Great Wall of China.

Most modern lottery draw games allow consumers to purchase tickets for future drawings with prizes ranging from fixed cash awards to forms of parimutuel or "parimutuality" (i.e., where the allocated portion of winnings are equally shared among all winners of a particular level) payouts. While lotteries and other gaming venues typically allow consumers to choose their own numbers or other indicia, a substantial majority of consumers make wagers via "quick picks"—e.g., allowing a random or pseudorandom number generator to select the wager numbers automatically for a consumer. One possible reason for the consumer's preference for quick picks is that (since it is unlikely that two people will receive the same "random" numbers) the possibility of multiple winners for the same drawing is presumably less, whereas "parimutuality" type draw games inherently can result in the undesirable consequence of a large number of winners for any given drawing, resulting in each winner realizing a significantly reduced prize.

This problem of wagering for a draw game prize where the prize return is uncertain at the time of wager is endemic with most large draw game prizes. For example, if the "parimutuality" game Powerball® realized sales of $100,000,000 with a 50% prize fund and only one ticket had the winning numbers for a given drawing, the ticket holder would be awarded a prize valued at $50,000,000. However, with the same Powerball sales of $100,000,000 and 50% prize fund, if there were two winning tickets for the same drawing, each ticket holder would only receive $25,000,000 instead of the $50,000,000 prize award with a single winner. This reduction in individual player winnings would continue as more winning tickets were identified for a given drawing.

Aside from the problem of potentially varying prize payouts, the classical fixed number of outcomes for a given draw game type dictate various prize tiers that may not be appealing to all types of consumers. For example, assume three different draw games, all with different wager types, all with 100% payouts, and all where each wager costs $1. Thus, the three exemplary draw games could be:

a 1 in 10,000 chance of winning $10,000
a 1 in 100 chance of winning $100
or, a 1 in 2 chance of winning $2

In this example, most people would play the long odds game of "1 in 10,000 chance of winning $10,000." However, if the same three draw games with 100% payout were played where each wager now cost $100 (i.e., a 1 in 10,000 chance of winning $1,000,000; a 1 in 100 chance of winning $10,000; or a 1 in 2 chance of winning $200) most people would probably play the short odds game of "1 in 2 chance of winning $200." The difference being that for most people the pain of losing $100 is greater than losing $1. Thus, concepts like "price point", "payout", and "hit frequency" translate to consumers feeling both satisfaction and pain—or, to put it another way, no existing draw game can work for all consumers because every consumer does not feel satisfaction and pain the same way.

Some notable attempts have been made to introduce variable odds and payouts into various gambling games—e.g., U.S. Pat. Nos. 5,938,196 (Antoja); 6,234,478 (Smith); 8,662,998 (Schueller); and 9,687,740 (Grubmueller). However, Antoja simply teaches implementing slot machine adjustable pay schedules with a predictable payout (column 2, lines 8 through 11) and is therefore limited in its applicability to most draw games as well as its restricted pay schedules enabling only a small amount of variability. These same basic concepts are taught in a different, game dial, embodiment in Smith with consequently the same disadvantages. Schueller teaches the same general concept with the embodiment of electronically swapping various "assets" that in some embodiments can include pay schedules or tables; thereby offering greater variety, but with limited applicability to draw games in general. Finally, while Grubmueller does specifically addresses draw games, the adjustability and variability of Grubmueller is achieved with the inclusion of "side events" that are linked to a "main event" or drawing. Therefore, with Grubmueller the odds, flexibility, and payout of the "main event" draw game remains unaltered with only "side events" or bets offering variability. Thus, the prior art is largely silent on how to introduce variable odds, flexibility, and payouts to a single draw game event.

Prior art related to providing fixed assured payouts with parimutuel wagering systems tend to be focused on horse race tracks (e.g., U.S. Patent Application Publication No. 2009/0131132 (Kohls et al.). However, horse race tracks are relatively small networks where delivering parimutuel odds and other data in real time or near rear time does not pose any significant computational challenge, with the actual payouts being available in real time at the time of the wager. In contrast, lottery related draw game systems prior art tends to exclusively focus on new types of games and the systems to support them with no regard to enabling fixed payouts at the time of wagering and/or variable odds, flexibility, and payouts to a single draw game event—e.g., U.S. Patent Application Publication Nos. 2003/0050109 (Caro et al.); 2004/0058726 (Klugman); 2009/0131132 (Kohls et al.); 2009/0227320 (McBride); 2010/0222136 (Goto et al.); 2011/0281629 (Meyer); 2013/0244745 (Guziel et al.); and U.S. Pat. No. 8,747,209 (Badrich).

Therefore, in order to enhance the appeal of draw games to a broader market base, it is highly desirable to develop draw game systems where prize payouts are known at the time of the wager where a consumer or other entity can select his or her desired odds and payout. Ideally, these draw game systems are game type independent, thereby offering the greatest utility to lotteries and other draw game system providers.

SUMMARY OF THE INVENTION

Objects and advantages of the present invention will be set forth in part in the following description, or may be obvious from the description, or may be learned through practice of the present invention.

A method and system are provided for variable and flexible draw game systems utilizing computer hardware. The variability and flexibility of the present invention is principally derived by subdividing one universal drawing event into a series of variable sized "bins" that reduce wagered odds to a subset of the greater odds of the universal drawing. This reduction in wagered odds (i.e., greater chance of winning from a consumer's perspective) is achieved by creating a plurality of bins, each containing a portion of the possible universal drawing outcomes, the totality of bins thereby containing 100% of the possible drawing outcomes. Once the correct number of bins required to achieve the desired odds and associated payout is created, a consumer selects or is assigned a number (modulo) and bin size required to provide the desired odds and payout. A modulo operation is then performed to create a series of pointers, one or more pointer(s) for each of the created bins. Each pointer thereby selects at least one unique draw bet number in each bin, the totality of the selected draw bet numbers from all the bins constituting the consumer's wager for the universal drawing. Thus, by varying the number of bins and/or the modulus, a substantial plurality of variable wager odds and corresponding prize payouts can be achieved so long as the selected odds are less than the overall odds for the universal drawing.

Whenever a wager is made, the selected or assigned modulo number is printed on the wager ticket receipt along with the selected payout. When the drawing occurs, the associated winning modulo number for each prize payout level can be posted, thereby allowing consumers to easily determine if their particular wager won a prize by simply looking up their prize payout level and seeing if their printed wager number matched the winning number for that prize payout.

Described are mechanisms, systems, and methodologies related to constructing variable odds draw game systems utilizing computer hardware thereby enabling methods of inexpensive operation enabling hitherto unknown variable and flexible betting formats from a common universal draw game. The key innovations are the division of all possible outcomes into a series of n bins as well as assignments of corresponding numbers and moduli at the time a wager is made, thereby enabling high-speed variable and flexible betting.

In a general embodiment, a draw game system is disclosed that provides consumer selectable varying odds and payouts in real time that are not available via prior art systems. The variability and flexibility of the present invention is achieved from determining the desired bin size and corresponding number and modulus for the desired odds at the time of wager. After the drawing occurs, the redemption system utilizes the stored bin sizes as well as the associated moduli numbers from all wagers to determine the appropriate winners (if any) for the single universal drawing.

As an inherent aspect of this general embodiment, the disclosed variable and flexible draw game system architecture readily accommodates ergonomic consumer redemption by displaying the wager number that was assigned to the bet at the time of the wager on the draw game paper ticket or digital embodiment. This displayed number can be verified against posted winning modulo numbers for the odds wagered. This is possible because there is only one winning number and modulo for each set of odds. Thus, the consumer only needs to know his or her number to determine if the wager was a winner. Alternatively, a consumer would have to check their millions, billions, trillions, etc. of numbers wagered to determine if any one matched the universal draw number.

This inherent aspect of the saved modulo for each bet determining the winner further expedites the drawing settlement process—i.e., after sales for a particular draw game are closed and the winning sequence of numbers is determined. After the drawing process is completed, the relatively trivial calculations needed to determine a winner with each set of bet odds allows winning tickets to be settled almost immediately.

In a specific embodiment, the draw game system enabled by the present invention provides can provide fixed (i.e., guaranteed) payout values at the time of wager for vast pluralities of odds instead of approximate amounts typical of parimutuel or "parimutuality" draw games. These fixed payout values are sustainable since a common Expected Value (EV) is maintained across all bet odds.

In another specific embodiment, the variable draw game system supports consumer selectable modulo numbers from a given range. These consumers selectable modulo numbers can be in the form of direct selection or the result of a game (e.g., virtual digital rotary wheel).

In an alternative embodiment, the variable and flexible draw game system is configured to provide a flexible progressive type wagering opportunity where the plurality of virtual bins remains static over a plurality of universal drawings. Thus, subsets of matching numbers or other indicia from the plurality of universal drawings can be specified such that once a predetermined threshold of matching number subsets is achieved for an individual consumer, a prize is awarded. Since there will be an uncertain number of universal drawing iterations until the prize is awarded, the progressive jackpot will increase each time a universal drawing is played and the jackpot is not won. When the progressive jackpot is won, the jackpot for the next play is reset to a predetermined value, and resumes increasing under the same method.

Described are a number of mechanisms and methodologies that provide practical details for reliably developing a variable and flexible draw game system from commonly available (i.e., low cost) hardware that also provides for scalability. Although the examples provided herein are primarily related to lottery draw games, it is clear that the same methods are applicable to any type of wagering system where a large number of possible outcomes are possible.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 2A-2 is a front elevation representative example of a variable draw game betting human interface where the consumer selects the odds that is compatible with the present invention;

FIG. 5 is a flowchart of one preferred embodiment of the present invention.

DETAILED DESCRIPTION OF THE INVENTION

Figure 1A:
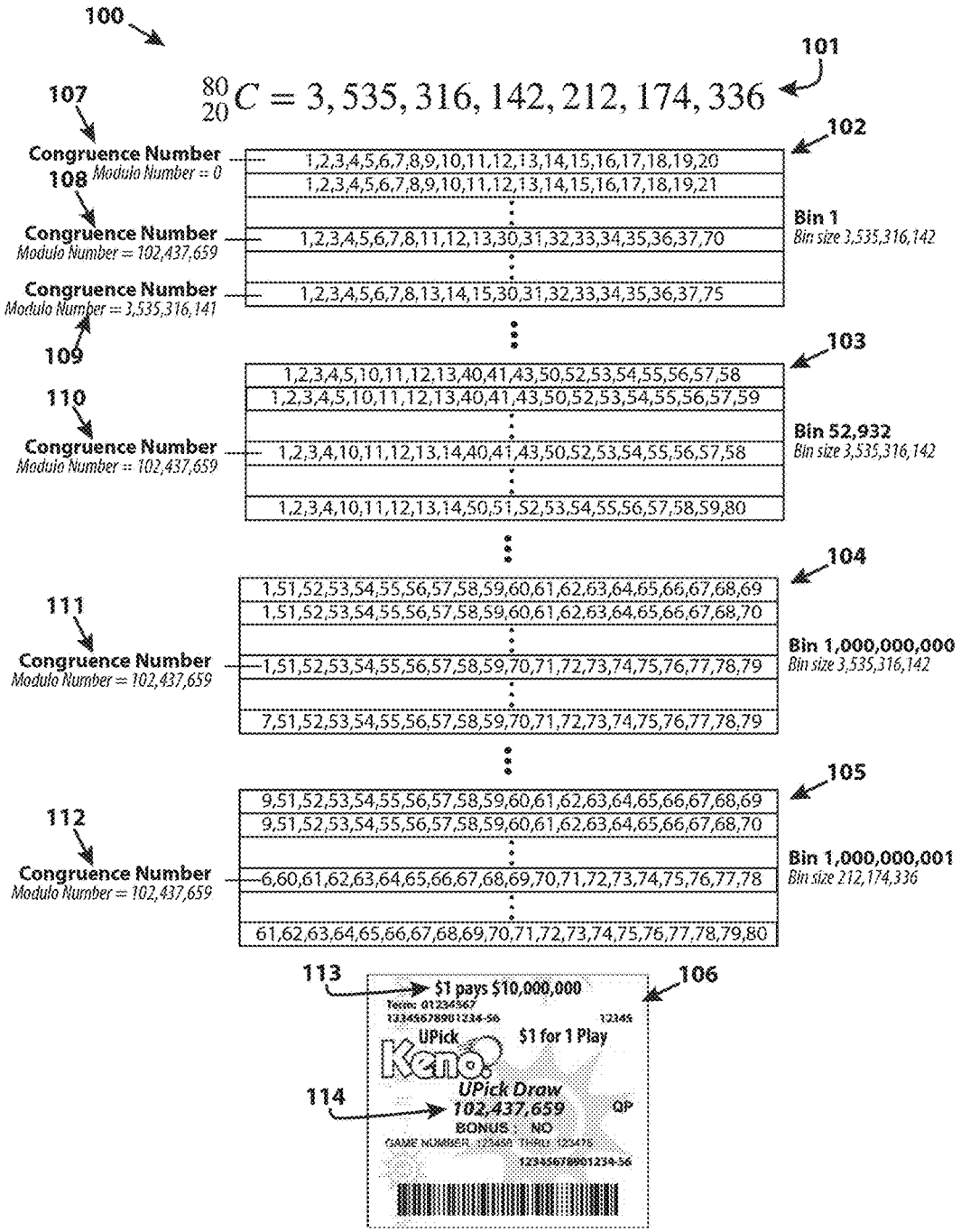
FIG. 1A is a representative example diagram defining the plurality bin and modulo number assignments at the time of a wager for a variable draw game system embodiment as enabled by the present invention.

Certain terminology is used herein for convenience only and is not to be taken as a limitation on the present invention. The words "a" and "an", as used in the claims and in the corresponding portions of the specification, mean "at least one." In the context of the present invention, the term "parimutuality" refers to a lottery type draw game where bets are placed on an outcome, the payout per winner is determined by the sum of all bets (less the house take), and the potential payout is known only approximately at the time the wager is made. In contrast, in a true parimutuel game (e.g., horse race, greyhound racing, jai alai, sporting events with ranked outcomes), the winning amounts would still be determined by the money wagered; however, the exact payout would be known to the consumer at the time of the wager with the payout being principally determined by the total amount of money already wagered and how the wagers are distributed among potential outcomes. A "wager" or "bet" as used interchangeably in the claims and in the corresponding portions of the specification means a gamble on predicting the outcome of a drawing in the future. When discussing "wagers" or "bets", for brevity, both the specification and the claims describe the wager or bet in terms of "numbers"; however, in the context of this disclosure, it is defined that the term "numbers" may also include other draw game indicia (e.g., play cards, letters, lucky symbols). Additionally, the term "draw game" refers to a wager made for some drawing in the future. As a practical matter, this future drawing can be a ping-pong draw machine, a Random Number Generator (RNG), a slot machine "pull," or the like.

In the context of the present invention, a "bin" is a virtual subset of all possible outcomes from a drawing, with each outcome in each "bin" associated with its own unique modulo pointer. Therefore, the set of all "bins" would contain all possible outcomes for a given drawing. The number of virtual "bins" assigned for a drawing varying by the desired odds and payouts. Finally, the term "congruence number" as used in the claims and in the corresponding portions of the specification, is defined as the number embodied in each bin location specified by a given modulo pointer. The "congruence numbers" thereby designate the set of numbers or other indicia wagered in a specific drawing's outcome.

Before describing the present invention, it may be useful to first provide a brief description of the current state of the art of draw game execution and validation as well as the various types of consumers that are attracted to different types of draw games. The concept is to ensure that a common lexicon is established of existing systems prior to describing the present invention.

Typical lottery style draw games include Pick 3, Pick 4, Mega Millions®, Powerball, and Keno. Other types of draw games include raffles, slot machines, Bingo, and horse races. The key concept is a wager is made in advance betting on the outcome of some drawing in the future. In all prior art embodiments, there is some protocol or system (e.g., lottery terminal and central site, paper raffle ticket, Bingo card, Keno draw game ticket) that essentially records the bet, thereby locking the wager in advance of the actual drawing. Typically, drawings are based on a fix set of possible numbers or other indicia where some subset of numbers or other indicia are selected (or "drawn") through a random or pseudorandom process in a future "drawing." Therefore, since typical prior art draw games involve selecting a subset of numbers or indicia from a larger set, the probability and odds are defined by the laws of mathematics. Thus, changing the odds and corresponding payoff requires changing the fix set of numbers or indicia to be drawn and/or the subset of numbers or other indicia that are selected.

However, different types of consumers prefer different types of draw games, usually equating to some function of "price point," "payout," and "hit frequency." Stereotypically, this equates to four different kinds of generic consumers:

- "Grind" consumers: prefer frequent chances to win—e.g., "Pick 3"
- "Punters": prefer medium or larger wins—e.g., "Fantasy 5"
- "Discovery" consumers: prefer unique features and are often focused on mid-payouts—e.g., "Keno"
- "Jackpot" consumers: prefer games that include very large, typically unattainable payouts—e.g., "Powerball"

Simply put, no prior art draw game can work for all consumers, because every consumer does not prefer the same types of odds and hit frequency. The prior art draw games odds and hit frequency are driven by the laws of probability (i.e., a function of the number of possible indicia to be drawn from and the number of possible indicia drawn and optionally, the order of the indicia drawn) and consequently are unable to accommodate all types of consumers with a single draw game.

The present invention thus eliminates this problem by allowing all consumers to "tune" a given, long shot, draw game to whatever odds and hit frequency they desire. For example, the largest possible odds for a game of Keno (typically, 80 choose 20 where all twenty numbers were correctly selected) is approximately 1 in 3.5 quintillion—1 in 3,535,316,142,212,174,336 to be exact. Therefore, with the existing prior art game of Keno, the possible wagers are limited to correctly selecting 0 to all 20 numbers with the corresponding odds fixed by the laws of probability; i.e.,

| Hits | Probability |
|---|---|
| 0 | 1 in 1,551 |
| 1 | 1 in 4 |
| 2 | 1 in 17 |
| 3 | 1 in 72 |
| 4 | 1 in 326 |
| 5 | 1 in 1,551 |
| 6 | 1 in 7,754 |
| 7 | 1 in 40,979 |
| 8 | 1 in 230,114 |
| 9 | 1 in 1,380,687 |
| 10 | 1 in,911,711 |
| 11 | 1 in 62,381,978 |
| 12 | 1 in 478,261,833 |
| 13 | 1 in 4,065,225,581 |
| 14 | 1 in 38,910,016,281 |
| 15 | 1 in 428,010,179,098 |
| 16 | 1 in 5,564,132,328,278 |
| 17 | 1 in 89,026,117,252,453 |
| 18 | 1 in 1869,548,462,301,520 |
| 19 | 1 in 57,956,002,331,347,300 |
| 20 | 1 in 3,535,316,142,212,174,336 |

However, with the benefits inherent with the present invention, a draw game wager can be offered for virtually any odds and related payout for the same drawing so long as the produced odds are less than the largest possible odds for a game of Keno (i.e., 1 in 3,535,316,142,212,174,336). Consider the example wherein six different consumers desired the following six different odds for wagers:

1 in 10,000
1 in 100,000
1 in 1,000,000
1 in 10,000,000
1 in 100,000,000
1 in 1,000,000,000

If so, then a single universal Keno drawing event could support these six different odds by assigning six different numbers with associated moduli and creating six different sets of bin sizes to accommodate the desired odds, as follows:

| Odds Desired 1 in: | BinSize |
|---|---|
| 10,000 | $3.53 * 10^{14}$ |
| 100,000 | $3.53 * 10^{13}$ |
| 1,000,000 | $3.53 * 10^{12}$ |
| 10,000,000 | $3.53 * 10^{11}$ |
| 100,000,000 | $3.53 * 10^{10}$ |
| 1,000,000,000 | $3.53 * 10^{9}$ |

Thus, with the present invention, any number of variable bets with differing payouts can be accommodated with a single universal drawing so long as the various bets feature odds are less than the largest possible odds inherent in the universal drawing. Additionally, a common rake or profit for all bets in the universal drawing can be maintained by preserving the same desired rake or profit percentage across all bets when calculating the payoff. The computational ease with which these calculations can be performed readily accommodates adoption by existing draw game systems, thereby providing variable fixed odds for all bets in real time.

Having concluded the discussion of an exemplarity prior art draw game execution, validation, and associated consumers, embodiments of the present invention will now be disclosed. As will be apparent to one skilled in the art, the present invention overcomes many of the inherent disadvantages of draw games, particularly enabling greater flexibility with consumer choices and play style.

Reference will now be made in detail to examples of the present invention, one or more embodiments of which are illustrated in the figures. Each example is provided by way of explanation of the invention, and not as a limitation of the invention. For instance, features illustrated or described with respect to one embodiment may be used with another embodiment to yield still a further embodiment. It is intended that the present application encompass these and other modifications and variations as come within the scope and spirit of the invention.

Preferred embodiments of the present invention may be implemented as methods, of which examples have been provided. The acts performed as part of the methods may be ordered in any suitable way. Accordingly, embodiments may be constructed in which acts are performed in an order different than illustrated, which may include performing some acts simultaneously, even though such acts are shown as being sequentially performed in illustrative embodiments.

Figure 1B:
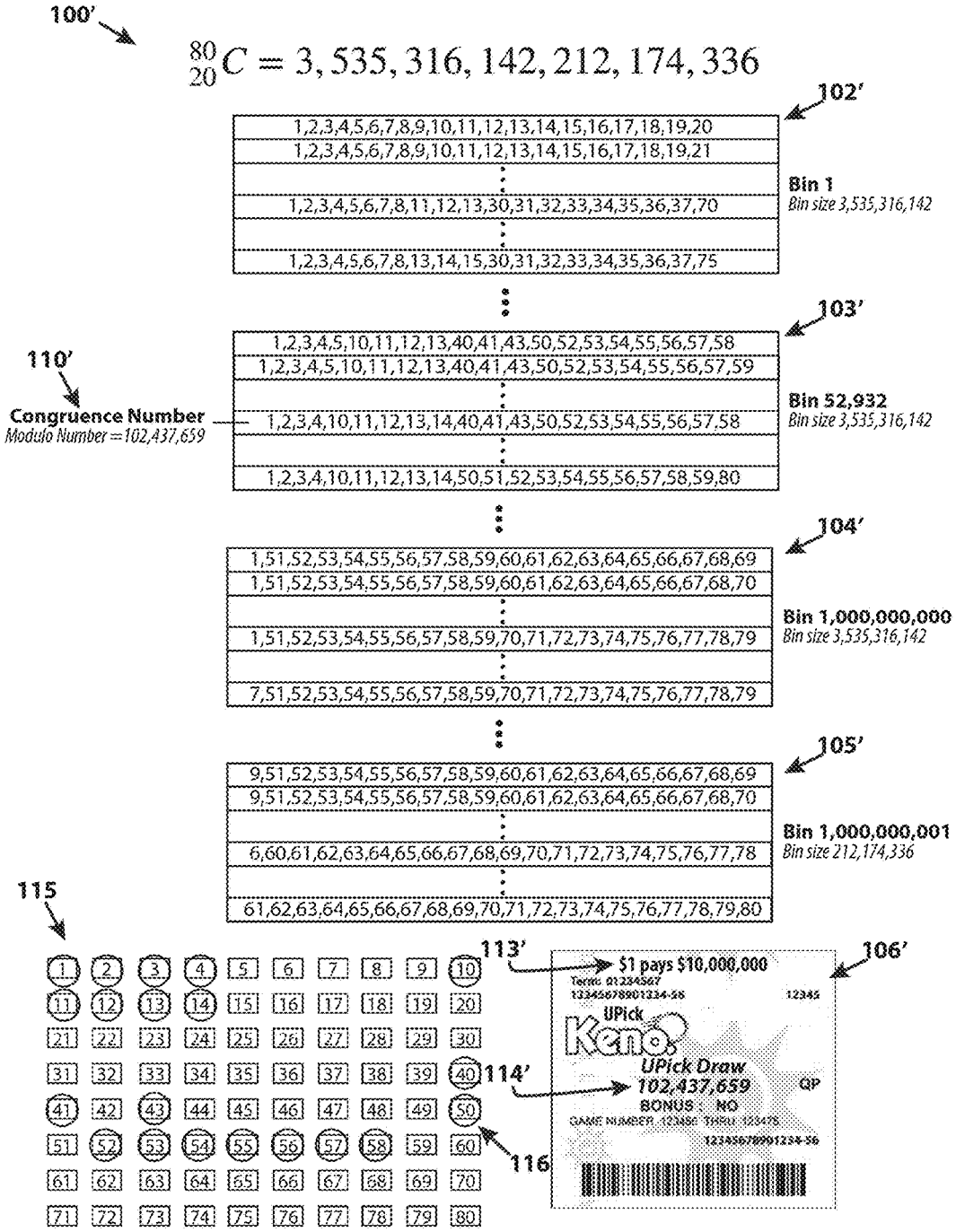
FIG. 1B is a representative example diagram defining the plurality bin and modulo number assignments at the time of redemption for a variable draw game system that is compatible with the representative example embodiment of FIG. 1A.

FIGS. 1A and 1B, taken together, illustrate one general embodiment describing the plurality bin and modulo number assignments for a variable draw game system. FIG. 1A illustrates the state of the system at the time a wager is made by a consumer while FIG. 1B illustrates the state of the same system at the time a consumer attempts a redemption.

In the exemplary system 100 of FIG. lA the universal drawing event, from which the variable wager odds and corresponding prize payouts from the present invention are derived, will be from an exact "pick 20 from 80" typical Keno drawing 101, resulting in overall universal drawing odds of "1 in 3,535,316,142,212,174,336." From this one overall drawing 101 to be held in the future, this exemplary system 100 is shown to produce a draw game ticket 106 documenting a wager where the consumer has selected odds with a winning prize payout valued at "$1 pays $10,000,000" 113 resulting in the generation of a billion virtual bins with each bin holding a series of "3,535,316,142" (102 through 104) sequential drawing number outcomes with each specific outcome functioning as a "congruence number" for a given modulo number (e.g., 107 through 111)—i.e., each virtual bin contains a unique sequential series of "3,535,316,142" congruence numbers. However, the odds and payout selected by the consumer 113 (i.e., "$1 pays $10,000,000") necessitates an additional remainder bin 105, containing less than "3,535,316,142" sequential drawing number outcomes (i.e., congruence numbers), to be created that holds the remaining "212,174,336" series of sequential drawing or congruence number outcomes. The totality of all the bins (i.e., the billion bins—102 through 104—each sized "3,535,316,142" and the single remainder bin—105—sized "212,174,336") thereby providing a complete listing of all possible outcomes "3,535,316,142,212,174,336" of the exemplary "pick 20 from 80" Keno universal drawing event 101.

Thus, for the single $1 wager, the consumer has effectively selected or "quick picked" one billion and one drawing outcomes, a single outcome from each bin with a single modulo number 114 (i.e., "102,437,659"). Traditionally this type of odds division was viewed as impractical—i.e., how can a consumer possess a ticket listing one billion and one drawing outcomes; or more to the point, how can a consumer verify that he or she has won a drawing from one billion and one wagers? However, with the modulo pointer innovation of the present disclosure the totality of the consumer's one billion and one wagers can be reduced to a single modulo number 114 (i.e., "102,437,659"). The modulo number 114 simply designating a specified location to a single congruence number (and thereby corresponding draw number wager) in each of the bins. The modulo nature of the pointer number 114 allows the pointer to essentially roll over from the end to the beginning of the bin if the modulo number exceeds the size of the bin. Consequently, there can be only one congruence (draw) number outcome selected per bin.

FIG. 1B illustrates 100' the same exemplary universal drawing event 100 of FIG. 1A. However, FIG. 1B illustrates the state of the same system at the time the consumer that purchased the wager attempts to determine if he or she has won a prize. The outcome of the universal drawing event 115 (i.e., "pick 20 from 80" typical Keno drawing) is illustrated with the winning numbers highlighted with circles (e.g., 116), the winning sequence in this example being the twenty numbers: "1, 2, 3, 4, 10, 11, 12, 13 ,14, 40, 41, 43, 50, 52, 53, 54, 55, 56, 57, and 58." Therefore, to determine if the exemplary consumer's ticket 106' has won the wager (i.e., "$1pays $10,000,000") 113', the ticket's modulo number 114' is used to provide a pointer to a single congruence (draw) number within each of the one billion and one virtual bins (102' through 105'). If one of the one billion and one corresponding congruence numbers is the winning sequence of draw numbers 115, the consumer wins "$10,000,000," otherwise the consumer loses this particular drawing. In this particular example 100', the modulo number 110' points in bin 103' to the single winning congruence number sequence 110'—i.e., "1, 2, 3, 4, 10, 11, 12, 13 ,14, 40, 41, 43, 50, 52, 53, 54, 55, 56, 57, and 58." Thus, in this example, the consumer's ticket 106' with the nine digit modulo number 114' ("102,437,659") is in fact a winner, with the winning modulo number "102,437,659" 114' for any wager of "$1 pays $10,000,000" 113' publicly announced and posted such that the consumer can easily determine if he or she has won.

As is apparent to one skilled in the art, the present disclosure overcomes many of the inherent disadvantages of draw games, particularly designing a draw game that is appealing to a broad spectrum of consumers (e.g., "grind," "punters," "discovery," "jackpot"). Of course, as would be apparent to one skilled in the art in view of this disclosure, alternate embodiments of the present invention (e.g., pseudorandom distribution of the potential draw numbers throughout the bins, offering only a fixed number of predefined odds and payouts for the consumer to wager, offering parimutuel payouts for varying odds, promotional overlay games), etc. may under some circumstances be more desirable.

In an alternative embodiment, the variable and flexible draw game system is configured to provide a flexible progressive type wagering opportunity where the plurality of virtual bins remains static over a plurality of universal drawings. Thus, subsets of matching numbers or other indicia from the plurality of universal drawings can be specified (e.g., match fifteen) such that once a predetermined threshold of matching number subsets is achieved for an individual consumer, a prize is awarded. Since there will be an uncertain number of universal drawing iterations until the prize is awarded, the progressive jackpot will increase each time a universal drawing is played with the jackpot not won. When the progressive jackpot is won, the jackpot for the next play is reset to a predetermined value, and resumes increasing under the same method.

For example, a progressive jackpot could be offered across multiple universal drawings where the progressive prize is awarded when "19 out of 20" numbers were correctly selected by a consumer's modulo number with odds of "1" in "3,002,400" per drawing. The same generation of a billion virtual bins (102 through 104) of 100 of FIG. 1A with each bin holding a set of "3,535,316,142" sequential drawing number outcomes or "congruence numbers" plus the additional remainder bin 105 holding the remaining "212, 174,336" set of congruence numbers could be employed for a progressive "19 out of 20" numbers match with the consumer's modulo number 114 (e.g., "102,437,659") and bins remaining static across the plurality of universal drawings until the progressive jackpot is won.

Figures 1, 2A:
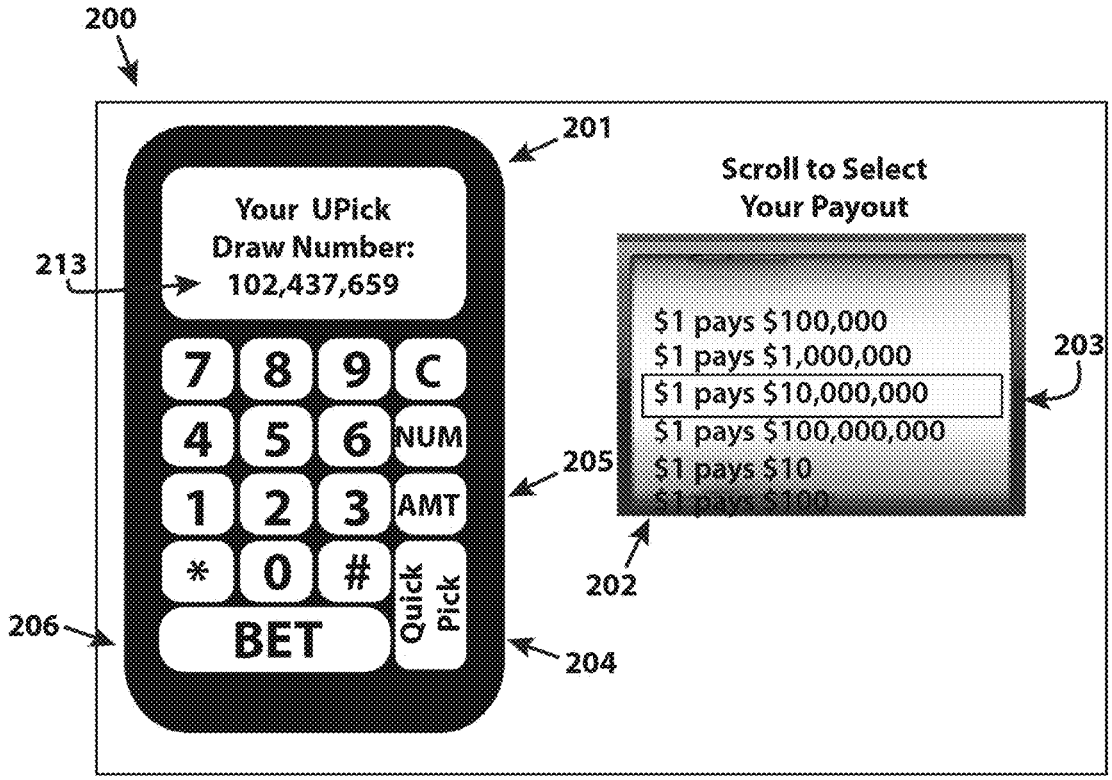
FIG. 2A-1 is a front elevation representative example of a variable draw game betting human interface where the consumer selects the payout that is compatible with the present invention.
Figures 2, 2A:
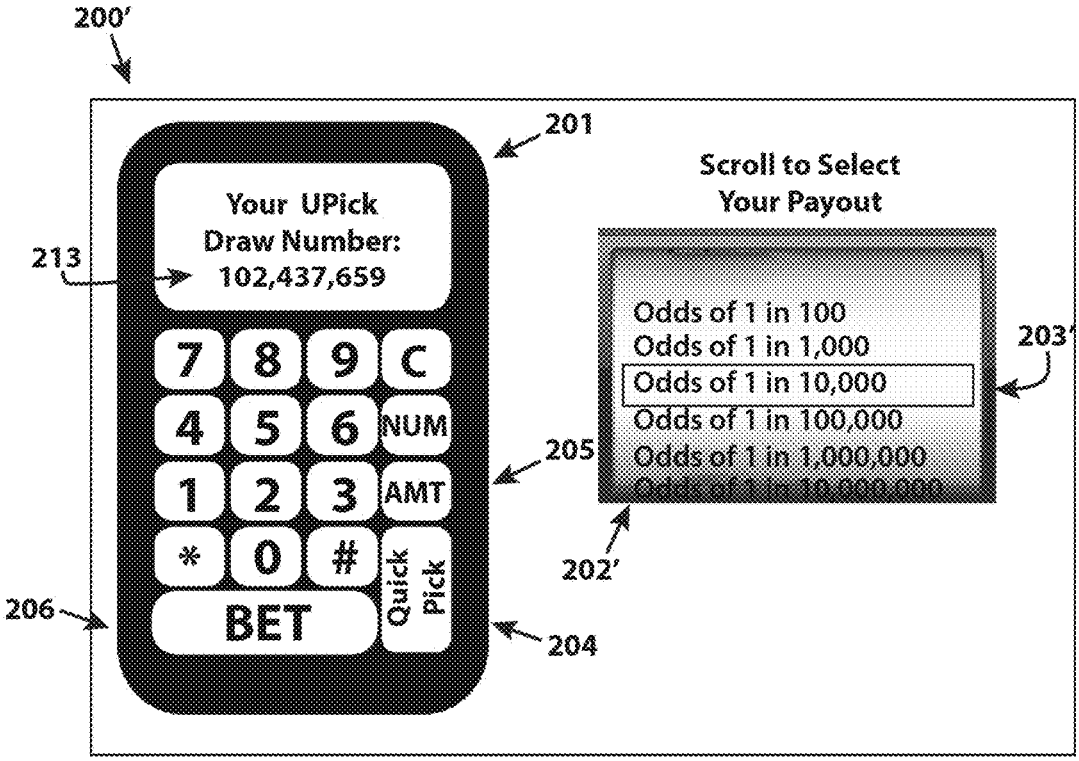

FIGS. 2A-1 and 2A-2 illustrate front elevation representative examples 200 and 200' of variable draw game betting human interfaces that are compatible with the embodiment of FIGS. 1A and 1B. As shown in FIGS. 2A-1 and 2A-2, there are two primary user interfaces inherent in variable and flexible draw game systems, namely, the keypad interface 201 where a consumer selects his or her modulo number and specifies the amount of the wager and optionally manually enters desired odds or payouts, and bin generation interface 202 and 202' where the consumer selects the payout 203 or odds 203' he or she wants to wager, which consequently determines the total number of virtual bins to be generated.

Typically, the consumer would first select their desired odds or payout via the virtual scroll wheel 202 and 202' as illustrated in these examples. Thus, in this example, the consumer would scroll through the wheel until the desired odds 203' or payout 203 was selected. At this point, the consumer would next select an "UPick Draw Number" (modulo number) 213 via "Quick Pick" 204 or manually keypad entry. While it is theoretically possible to accommodate virtually any "UPick Draw Number" 213, in a preferred embodiment, a range of possible "UPick Draw Numbers" may be displayed to aid the consumer in the selection process. Returning to the consumer selection process, after the consumer selects their "UPick Draw Number" (modulo number) 213 via manual key entry or "Quick Pick" 204, the consumer would typically be prompted to enter an amount to be wagered (e.g., $1 bet, $5 bet). This entered bet amount could be in response to a prompt or initiated by the consumer by actuating the "AMT" button 205. Once the: odds and corresponding payout 203, "UPick Draw Number" (modulo number) 213, and wager amount are selected; the consumer would typically finalize the wager by actuating the "BET" button 206 and then tendering a payment for the wager (not shown in FIG. 2A).

Of course, as is apparent to one skilled in the art, there are numerous variations on the exemplary user interface 200—e.g., the consumer could elect to select their "UPick Draw Number", or modulo number 213 before selecting the desired odds or payout was selected 203, the odds and pay out may be presented a priori to the consumer with the consumer only selecting the UPick Draw Number" or modulo number 213, or the consumer key entries (via 206) his or her desired odds or payout—that may under some circumstances be more desirable.

Figure 2B:
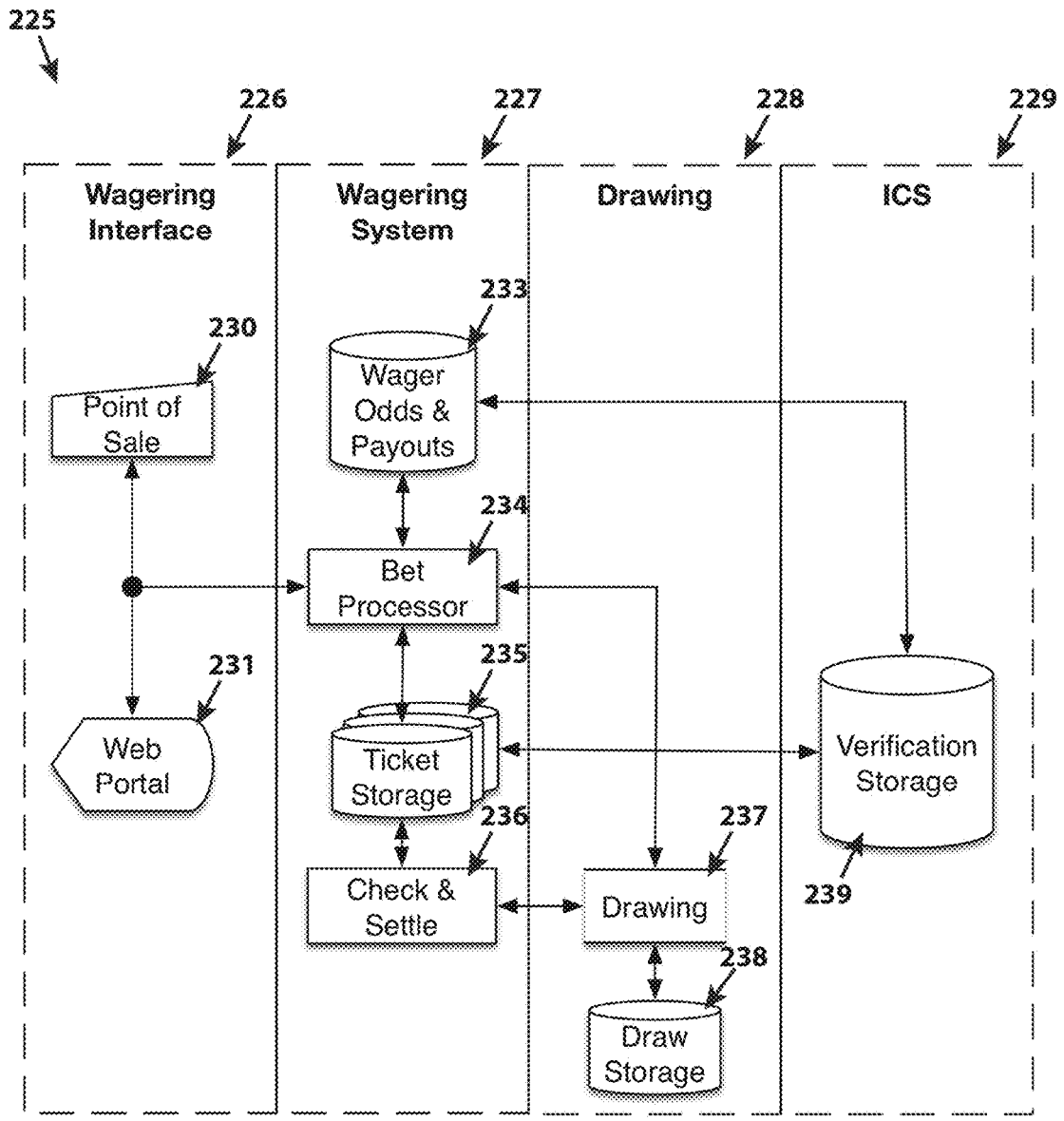
FIG. 2B is an overall swim lane flowchart representative example of the processes associated with issuing and redeeming a draw game ticket compatible with the specific embodiments of FIGS. 2A-1 and 2A-2.

As shown in the high-level architecture swim lane diagram 225 of FIG. 2B, there are four functional components (i.e., Wagering Interface 226, Wager System 227, Drawing 228, and Internal Control System or "ICS" 229) of the present invention. The Wagering Interface 226 (i.e., Point Of Sale or "POS" 230 and Web Portal 231) provides the transaction portal(s) that interact with specific consumers and/or operational staff, thereby enabling wagers or bets to be sold. All wagers or bets entered by the Wagering Interface 226 are passed to the Wagering System's 227 Bet Processor 234.

The Bet Processor 234 receives the proposed bet and if the requested odds or payout (e.g., 113 of FIG. 1A, 203 of FIG. 2A) is unique (i.e., the first time this specific odds or payout is requested for the pending universal drawing event 100 of FIG. 1A), then the Bet Processor 234 (FIG. 2B) will calculate the required number of bins and log the resulting calculated bin and congruence number segments into non-volatile Wager Odds & Payouts memory database 233. Once the calculated bin and congruence number segments are recorded, the pending bet selected modulo number is logged into non-volatile Ticket Storage memory 235 along with the associated requested odds or payout, thereby initiating a record of the pending bet. The remaining of bet processing is conducted in the normal (prior art) manner, with the bet assigned a unique serial number also logged into non-volatile Ticket Storage memory 235 with an acknowledgement ticket sent back to the Wagering Interface 226 device (230 or 231) that initiated the bet request, thereby documenting the bet. Typically, a hardcopy payable on demand ticket (e.g., 106 of FIG. 1A) is printed. Alternatively, or in addition to, a digital embodiment of the ticket may also be saved in a consumer's account or mobile device (e.g., smart phone).

Returning to the Bet Processor 234 (FIG. 2B) when it initially receives a bet, if a proposed bet's requested odds or payout is not unique (i.e., a previous bet has been logged on the Wager Odds & Payouts memory database 233 requesting the same odds) then the Bet Processor 234 will proceed as before, logging the pending bet selected modulo number into non-volatile Ticket Storage memory 235 along with the associated requested odds or payout, thereby initiating a record of the pending bet. As before, the remaining of bet processing is conducted in the normal (prior art) manner, with the bet assigned a unique serial number also logged into non-volatile Ticket Storage memory 235 with an acknowledgement ticket sent back to the Wagering Interface 226 device (230 or 231) that initiated the bet request, thereby documenting the bet.

Typically, on prior art systems, in addition to a Wagering System 227 there is also an Internal Control System ("ICS") 229 that functions as a non-volatile mirror Verification Storage database 239 to all Ticket Storage 235 bets recorded. Normally, the Verification Storage database 239 operates as a "Worm" (Write Once Read Many times) drive thereby ensuring that a robust audit trail is maintained for all bets. However, with the advent of the present disclosure, the ICS 229 should preferably be configured to also mirror the Wager Odds & Payouts database 223 into Verification Storage 239 in addition to the normal (prior art) Ticket Storage 235 such that a complete audit trail of all potential winning tickets can be maintained.

After the betting or wager period for a pending drawing is closed, a Drawing 237 determining the winning numbers or indicia for the universal drawing event (100 of FIG. 1A) is conducted, with the drawing results recorded in non-volatile Draw Storage 238 (FIG. 2B) that typically functions as a "Worm" drive. These drawing results are also passed from the Drawing 237 process to the Wagering System's 227 Check and Settle 236 process. Any apparent winning draw game tickets presented for redemption (e.g., 106' of FIG. 1B) to the Wagering System 227 are passed to the Check & Settle 236 service for validation and payment authorization. The Check & Settle 236 service then queries the Ticket Storage 235 database to determine if the bet was valid and if so, to ascertain the "UPick Draw Number" modulo number (e.g., 114' of FIG. 1B) as well as the associated odds or payout (e.g., 113' of FIG. 1B). At this point, the Check & Settle 236 (FIG. 2B) service queries the Wager Odds & Payouts database 233 to retrieve the bin and congruence number segments for the accompanying bet and then applies the bet's chosen modulo "UPick Draw Number" number to the various bins to determine if one of the congruence numbers (e.g., 110' of FIG. 1B) from the multiplicity of bins agrees with the universal drawing results (100' of FIG. 1B). If an exact match between one of the congruence numbers and the universal drawing result is determined, the draw game ticket (e.g., 106' of FIG. 1B) is declared a winner with the prize awarded, otherwise the ticket is declared a non-winner with no prize paid out.

Figure 3:
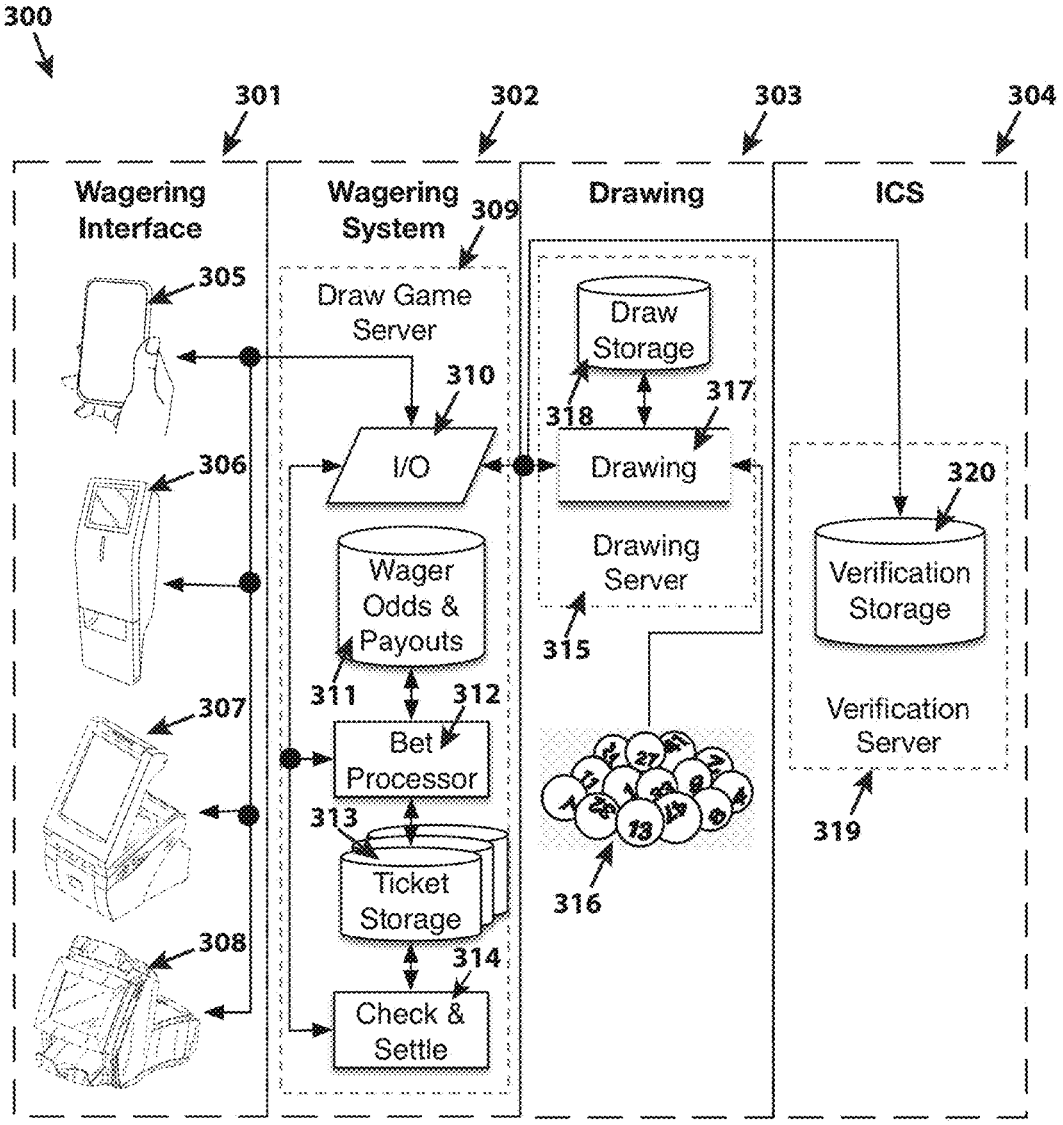
FIG. 3 is a representative example swim lane hardware block diagram of a draw game system embodiment as enabled by the present invention.

The related FIG. 3 swim lane system hardware architecture diagram 300 is also comprised of four functional components (i.e., Wagering Interface 301, Wager System 302, Drawing 303, and ICS 304) of the present invention, typically residing in separate devices or computing devices. The Wagering Interface 301 (e.g., hand held consumer device 305, kiosk 306, or retailer operated terminals 307 and 308) provides the transaction portal(s) that interact with specific consumers and/or operational staff, thereby enabling wagers or bets to be sold and redeemed. All wagers or bets received by the Wagering Interface 301 are passed to the Wagering System's 302 Draw Game Server 309 for processing, recording, and validation with the ICS 304 Verification Server 319 maintaining a mirror Ticket Storage 313 database on its Verification Storage 320 database.

As before, FIG. 3 begins with the Wagering Interface 301 providing the transaction portals (e.g., hand held consumer device 305, kiosk 306, or retailer operated terminals 307 and 308) that interact with specific consumers and/or operational staff, thereby enabling wagers or bets to be sold. All wagers or bets received by the Wagering Interface 301 are passed to the Wagering System's 302 Draw Game Server's 309 Bet Processor 312 service via one of its Input/Output (I/O) portals 310. The Bet Processor 312 receives the proposed bet and if the requested odds or payout is unique, then the Bet Processor 312 will calculate the required number of bins and log the resulting calculated bin and congruence number segments into non-volatile Wager Odds & Payouts memory database 311 with a copy also transferred via I/O 310 to the Verification Server's 319 Verification Storage 320 database. Once the calculated bin and congruence number segments are recorded, the pending bet would be processed as previously described with the bet assigned a unique serial number and logged along with the associated modulo number into non-volatile Ticket Storage memory 313. An acknowledgement is then sent back to the Wagering Interface 301 device (305 through 308) that initiated the bet request. Alternatively, if a proposed bet's requested odds or payout is not unique (i.e., a previous bet has been logged requesting the same odds) then the Bet Processor 312 simply processes the pending bet in the previously described fashion.

After the betting or wager period for a pending drawing is closed, a drawing (e.g., ping pong ball selection 316) determining the winning numbers or indicia for the universal drawing event is conducted, with the drawing results entered into the Draw Server's 315 Drawing 317 process with the results also recorded in non-volatile Draw Storage 318. These drawing results are also passed from the Drawing 317 process to the Wagering System's 302 Check and Settle 314 process. Any apparent winning draw game tickets presented for redemption to the Wagering System 301 are passed to the Check & Settle 314 service for validation and payment authorization. The Check & Settle 314 service then queries the Ticket Storage 313 database to determine if the bet was valid and if so, to ascertain the modulo "UPick Draw Number" as well as the associated odds or payout. At this point, the Check & Settle 314 service queries the Wager Odds & Payouts database 311 to retrieve the bin and congruence number segments for the accompanying bet and then applies the bet's chosen modulo "UPick Draw Number" number to the various bins to determine if one of the congruence numbers from the multiplicity of bins agrees with the universal drawing results. If an exact match between one of the congruence numbers and the universal drawing result is determined, the draw game ticket is declared a winner with the prize awarded, otherwise the ticket is declared a non-winner with no prize paid out.

Figure 4:
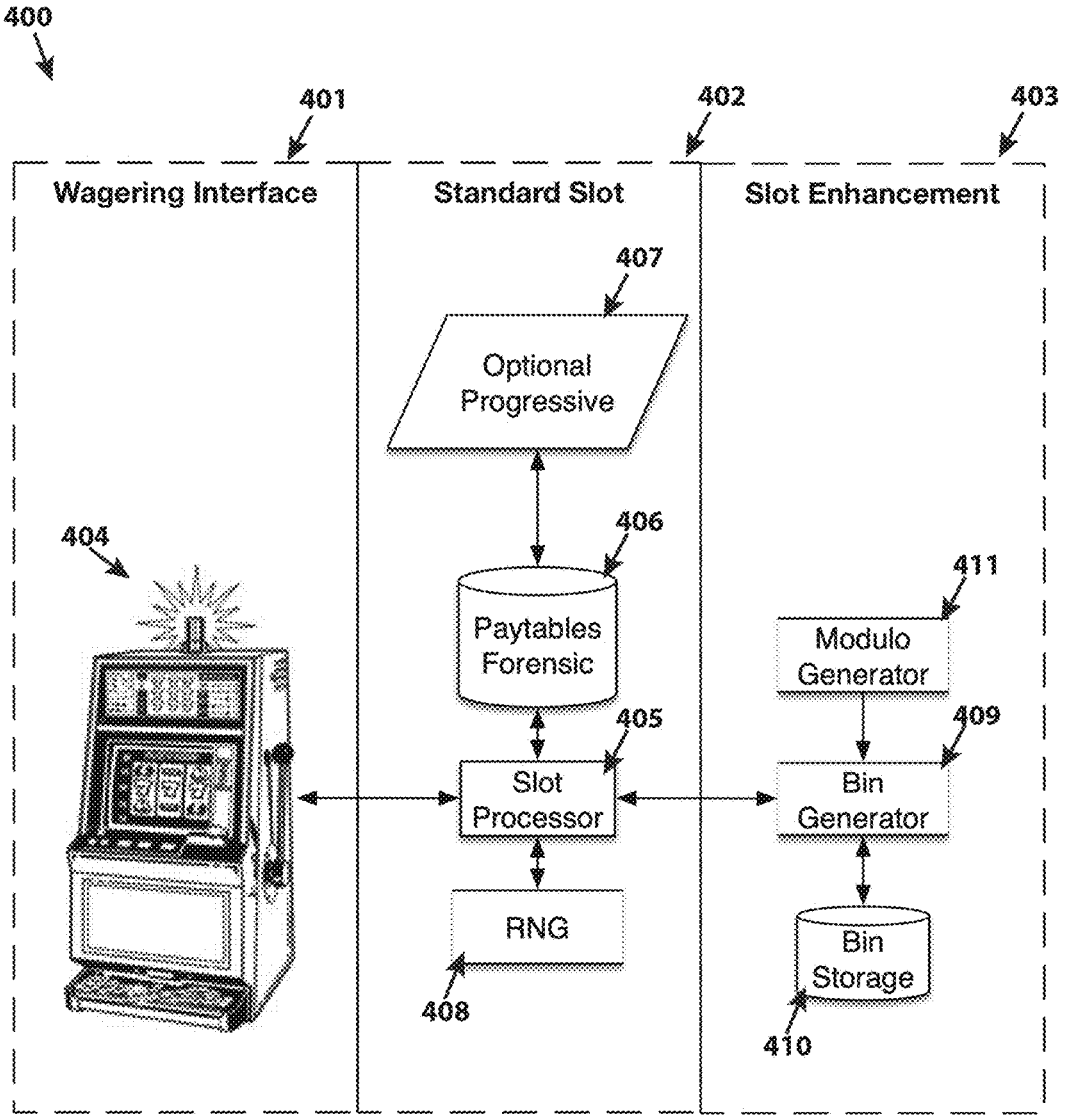
FIG. 4 is a representative example swim lane hardware block diagram of a draw game slot system embodiment as enabled by the present invention.

The FIG. 4 swim lane system hardware architecture diagram 400 provides an illustration of one possible alternative embodiment where the flexible draw game system utilizing computer hardware is employed in a slot machine 404. As illustrated in FIG. 4, this embodiment is comprised of three functional components (i.e., Wagering Interface 401, Standard Slot 402, and Slot Enhancement 403). The Wagering Interface 401 (e.g., floor cabinet slot machine 404) provides the transaction portal that interacts with specific consumers, thereby enabling wagers or bets to be sold. All wagers or bets received by the Wagering Interface 401 are passed to the Standard Slot's 402 Slot Processor 405, which is typically housed within the slot machine's 404 cabinet. As part of the Standard Slot's 402 normal operational services, a pay table database 406 is maintained for all standard (prior art) bets as well as typically functioning as a forensic database log of all bets and outcomes. Typically, for each bet, a Random Number Generator (RNG) 408 determines the win or lose outcome in accordance with the constraints as specified by the pay table database 406. The standard slot 402 functionality can also include an Optional Progressive 407 external interface to other slots or a to central site, thereby allowing portions of each bet to be allocated to a grand prize.

With the Enhancements 403 enabled by the present disclosure, the Standard Slot 402 is expanded to include flexible draw game functionality. As shown, this Slot Enhancement 403 functionality is comprised of a Bin Generator 409 and associated non-volatile Bin Storage 410 database memory. With this embodiment, if a consumer elects to enable flexible draw game functionality (or alternatively, internal logic of slot 404 determines to implement flexible draw game functionality where the odds or payout is selected by the internal logic transparent to the consumer), the pending bet and requested odds or payout are passed to the Bin Generator 409. If the requested odds or payout are unique, then the Bin Generator 409 will calculate the required number of bins and log the resulting calculated bin and congruence numbers segments into non-volatile Bin Storage memory database 410. Otherwise, if a proposed bet's requested odds or payout is not unique then the Bin Generator 409 simply references existing bin and congruence numbers segments from its Bin Storage 410 database. When the Bin Generator 409 is first contacted by the Slot Processor 405 it also requests and receives a unique modulo number from the Modulo Generator 411 for each bet request.

Once the modulo number, calculated bin, and congruence number segments are recorded, the pending bet would be processed by the RNG 408 generating a universal drawing result. If an exact match between one of the congruence numbers associated with the modulo number and the universal drawing result is determined, the bet wins and the prize is awarded.

FIG. 5 is a flowchart of one preferred embodiment of the present invention for enabling betting and redemption of draw game tickets with a plurality of different wager odds or payouts from a plurality of individual wagers made by consumers for one universal draw game to achieve a priori odds and a corresponding payout for an individual wager in the one universal draw game, using: (i) a plurality of n number of virtual bins that subdivide the largest possible odds of a universal draw game into a plurality of discrete bins of at least one size for each bin, each virtual bin being populated with a series of different congruence numbers representing a subset of all possible outcomes of the one universal draw game; and (ii) a modulo number, wherein the modulo number corresponds to a data pointer in n number of virtual bins such that the modulo number designates a single congruence number in each bin, the universal draw game having a draw game result. In one preferred embodiment, the following steps are performed:

STEP 500: Create, using a wagering system's bet processor, the n number of virtual bins of at least one size to be mathematically compatible with the odds or payouts, such that (i) each virtual bin contains a plurality of congruence numbers with each congruence number representing a different outcome from the plurality of possible outcomes of the universal draw game, and (ii) the totality of all virtual bins contains congruence numbers for all possible outcomes of the universal draw game.

STEP 502: Generate, using the wagering system's bet processor, the corresponding modulo number such that there is one unique modulo pointer position in each of the n virtual bins.

STEP 504: Save the n number of virtual bins and congruence numbers into non-volatile memory on a draw game system central site database.

STEP 506: Record in the wagering system's bet processor consumer selections of desired odds or payouts for universal draw game tickets purchased by the consumers, the consumer selection of odds or payouts being made when the universal draw game tickets are purchased. Th desired odds or payout may be selected from a predetermined set of odds or payouts, or may be selected from a range of odds or payouts.

STEP 508: Assign unique serial numbers to the purchased universal draw game tickets by the wagering system's bet processor, and save into the non-volatile memory on the draw game system central site database (i) the unique serial numbers, (ii) the corresponding consumer selected odds or payouts, and (iii) associated modulo numbers.

STEP 510: After the universal draw game has been concluded, use a wagering system's check and settle processor to validate the purchased universal draw game tickets against the universal draw game result by:

(i) retrieving the n number of virtual bins and congruence numbers associated with any universal draw game tickets submitted for validation from the draw game system central site database memory;

(ii) retrieving the modulo number associated with a universal draw game ticket submitted for validation from the draw game system central site database;

(iii) applying the retrieved modulo number to each of the retrieved n number of virtual bins to derive a unique congruence number from each bin, and testing each derived unique congruence number to determine whether it matches the universal draw game result; and (iv) paying the consumer winnings consistent with the odds or payout for the ticket's wager when one of the retrieved congruence numbers matches the universal draw game result.

It should be appreciated by those skilled in the art in view of this description that various modifications and variations may be made present invention without departing from the scope and spirit of the present invention. It is intended that the present invention include such modifications and variations as come within the scope of the appended claims.

What is claimed is:

1. A method for enabling betting and redemption of draw game tickets with a plurality of different wager odds or payouts from a plurality of individual wagers made by consumers for one universal draw game to achieve a priori odds and a corresponding payout for an individual wager in the one universal draw game, using: (i) a plurality of n number of virtual bins that subdivide the largest possible odds of a universal draw game into a plurality of discrete bins of at least one size for each bin, each virtual bin being populated with a series of different congruence numbers representing a subset of all possible outcomes of the one universal draw game; and (ii) a modulo number, wherein the modulo number corresponds to a data pointer in n number of virtual bins such that the modulo number designates a single congruence number in each bin, the universal draw game having a draw game result; the method comprising:

(a) creating, using a wagering system's bet processor, the n number of virtual bins of at least one size to be mathematically compatible with the odds or payouts, such that:

(i) each virtual bin contains a plurality of congruence numbers with each congruence number representing a different outcome from the plurality of possible outcomes of the universal draw game; and (ii) the totality of all virtual bins contains congruence numbers for all possible outcomes of the universal draw game;

(b) generating, using the wagering system's bet processor, the corresponding modulo number such that there is one unique modulo pointer position in each of the n virtual bins;

(c) saving the n number of virtual bins and congruence numbers into non-volatile memory on a draw game system central site database;

(d) recording in the wagering system's bet processor consumer selections of desired odds or payouts for universal draw game tickets purchased by the consumers, the consumer selection of desired odds or payouts being made when the universal draw game tickets are purchased;

(e) assigning unique serial numbers to the purchased universal draw game tickets by the wagering system's bet processor, and saving into the non-volatile memory on the draw game system central site database (i) the unique serial numbers, (ii) the corresponding consumer selected desired odds or payouts, and (iii) associated modulo numbers;

(f) after the universal draw game has been concluded, using a wagering system's check and settle processor to validate the purchased universal draw game tickets against the universal draw game result by:

(i) retrieving the n number of virtual bins and congruence numbers associated with any universal draw game tickets submitted for validation from the draw game system central site database memory;

(ii) retrieving the modulo number associated with a universal draw game ticket submitted for validation from the draw game system central site database;

(iii) applying the retrieved modulo number to each of the retrieved n number of virtual bins to derive a unique congruence number from each bin, and testing each derived unique congruence number to determine whether it matches the universal draw game result; and (iv) paying the consumer winnings consistent with the desired odds or payout for the ticket's wager when one of the retrieved congruence numbers matches the universal draw game result.

2. The method of claim 1 where the modulo number is determined by the consumer when the consumer purchases the draw game ticket.

3. The method of claim 1 wherein the desired odds or payout is selected from a predetermined set of odds or payouts.

4. The method of claim 1 wherein the desired odds or payout is selected by the consumer from a range of odds or payouts.

5. The method of claim 1 where the congruence numbers are non-numerical indicia.

6. The method of claim 1 where the draw game ticket is a physical embodiment printed on paper.

7. The method of claim 1 where the draw game ticket is a digital embodiment maintained on a consumer's device.

8. The method of claim 1 wherein step (c) further comprises maintaining an additional copy of the n number of virtual bins and congruence numbers on an Internal Control System (ICS) database memory.

9. A system for enabling betting and redemption of draw game tickets with a plurality of different wager odds or payouts from a plurality of individual wagers made by consumers for one universal draw game to achieve a priori odds and a corresponding payout for an individual wager in the one universal draw game, using: (i) a plurality of n number of virtual bins that subdivide the largest possible odds of a universal draw game into a plurality of discrete bins of at least one size for each bin, each virtual bin being populated with a series of different congruence numbers representing a subset of all possible outcomes of the one universal draw game; and (ii) a modulo number, wherein the modulo number corresponds to a data pointer in n number of virtual bins such that the modulo number designates a single congruence number in each bin, the universal draw game having a draw game result; the system comprising:

(a) a wagering system's bet processor configured to:

(i) create the n number of virtual bins of at least one size to be mathematically compatible with the odds or payouts, such that:

(A) each virtual bin contains a plurality of congruence numbers with each congruence number representing a different outcome from the plurality of possible outcomes of the universal draw game; and (B) the totality of all virtual bins contains congruence numbers for all possible outcomes of the universal draw game;

(ii) generate the corresponding modulo number such that there is one unique modulo pointer position in each of the n virtual bins;

(b) a draw game system central site database configured to save into non-volatile memory of the draw game system central site database the n number of virtual bins and congruence numbers;

the wagering system's bet processor being further configured to:

(iii) record consumer selections of desired odds or payouts for universal draw game tickets purchased by the consumers, the consumer selection of desired odds or payouts being made when the universal draw game tickets are purchased;

(iv) assign unique serial numbers to the purchased universal draw game tickets, and save into the non-volatile memory on the draw game system central site database (A) the unique serial numbers, (B) the corresponding consumer selected desired odds or payouts, and (C) associated modulo numbers;

(c) a wagering system's check and settle processor configured to validate the purchased universal draw game tickets against universal draw game results after the universal draw game has been concluded by:

(i) retrieving the n number of virtual bins and congruence numbers associated with any universal draw game tickets submitted for validation from the draw game system central site database memory;

(ii) retrieving the modulo number associated with a universal draw game ticket submitted for validation from the draw game system central site database;

(iii) applying the retrieved modulo number to each of the retrieved n number of virtual bins to derive a unique congruence number from each bin, and testing each derived unique congruence number to determine whether it matches the universal draw game result; and (iv) paying the consumer winnings consistent with the desired odds or payout for the ticket's wager when one of the retrieved congruence numbers matches the universal draw game result.

10. The system of claim 9 where the modulo number is determined by the consumer when the consumer purchases the draw game ticket.

11. The system of claim 9 wherein the desired odds or payout is selected from a predetermined set of odds or payouts.

12. The system of claim 9 wherein the desired odds or payout is selected by the consumer from a range of odds or payouts.

13. The system of claim 9 where the congruence numbers are non-numerical indicia.

14. The system of claim 9 where the draw game ticket is a physical embodiment printed on paper.

15. The system of claim 9 where the draw game ticket is a digital embodiment maintained on a consumer's device.

16. The system of claim 9 further comprising:

(d) an Internal Control System (ICS) database memory that maintains an additional copy of the n number of virtual bins and congruence numbers.

* * * * *